US006990694B2

(12) United States Patent
Poole

(10) Patent No.: US 6,990,694 B2
(45) Date of Patent: Jan. 31, 2006

(54) DEVICE AND METHOD FOR JOINING A PAIR OF SOCKS

(76) Inventor: David L. Poole, P.O. Box 55, Saint Paul, OR (US) 97137

( * ) Notice: Subject to any disclaimer, the term of this patent is extended or adjusted under 35 U.S.C. 154(b) by 0 days.

(21) Appl. No.: 10/696,470

(22) Filed: Oct. 28, 2003

(65) Prior Publication Data

US 2005/0086726 A1 Apr. 28, 2005

(51) Int. Cl.
*A43B 17/00* (2006.01)

(52) U.S. Cl. ..... 2/239; 24/DIG. 29

(58) Field of Classification Search ..... 2/139, 2/240, 241, 242, 409, 69, 1, 247; 24/DIG. 29, 24/30.5 S, 302; 224/918; 66/178 R, 169, 66/170, 171, 172, 173
See application file for complete search history.

(56) References Cited

U.S. PATENT DOCUMENTS

| | | | | | |
|---|---|---|---|---|---|
| 673,157 | A | * | 4/1901 | Burnham | 2/162 |
| 1,144,050 | A | * | 6/1915 | Nightingale et al. | 66/172 R |
| 1,361,565 | A | * | 12/1920 | Christy | 2/313 |
| 2,334,206 | A | * | 11/1943 | Knohl | 66/187 |
| 2,663,877 | A | | 12/1953 | Bohman | |
| 2,691,779 | A | * | 10/1954 | Bell | 2/239 |
| 2,779,076 | A | * | 1/1957 | Schenck, Sr. | 24/531 |
| 2,785,413 | A | | 3/1957 | Cook | |
| 2,814,807 | A | * | 12/1957 | Dollar | 2/239 |
| 3,492,674 | A | * | 2/1970 | Poole | 2/239 |
| 3,601,818 | A | | 8/1971 | Chesebro et al. | |
| 3,688,348 | A | * | 9/1972 | Klotz et al. | 24/16 R |
| D225,490 | S | * | 12/1972 | Sindelar | D2/994 |
| 4,058,853 | A | | 11/1977 | Boxer et al. | |
| 4,159,792 | A | * | 7/1979 | Siegal | 224/267 |
| 4,176,665 | A | * | 12/1979 | Terpening | 602/63 |
| 4,351,067 | A | * | 9/1982 | Bartels | 2/160 |
| 4,445,233 | A | * | 5/1984 | Rubin | 2/239 |
| 4,961,235 | A | * | 10/1990 | Williger | 2/239 |
| 5,027,440 | A | * | 7/1991 | Morris et al. | 2/239 |
| 5,038,413 | A | | 8/1991 | Ursino | |
| 5,230,333 | A | * | 7/1993 | Yates et al. | 607/111 |
| 5,325,542 | A | * | 7/1994 | Lenerville | 2/244 |
| 5,399,155 | A | * | 3/1995 | Strassburg et al. | 602/28 |
| 5,412,957 | A | * | 5/1995 | Bradberry et al. | 66/178 A |
| 5,470,059 | A | * | 11/1995 | Largent | 473/569 |
| 5,579,541 | A | | 12/1996 | Christy et al. | |
| 5,625,904 | A | * | 5/1997 | Kline | 2/239 |
| 5,651,142 | A | * | 7/1997 | del Valle Mas | 2/239 |
| 5,724,680 | A | * | 3/1998 | Cesnick et al. | 2/239 |
| 5,740,558 | A | | 4/1998 | Messman | |
| 5,742,945 | A | * | 4/1998 | Lindaman | 2/239 |
| 5,814,003 | A | | 9/1998 | Knox et al. | |
| 5,867,838 | A | * | 2/1999 | Corry | 2/239 |
| 5,918,318 | A | | 7/1999 | Jones | |
| 5,950,240 | A | * | 9/1999 | Carpenter et al. | 2/160 |

(Continued)

FOREIGN PATENT DOCUMENTS

| | | |
|---|---|---|
| WO | WO 91/04684 | 4/1991 |

*Primary Examiner*—Alissa L. Hoey
(74) *Attorney, Agent, or Firm*—Kolisch Hartwell, P.C.

(57) ABSTRACT

A sock comprising first and second openings positioned along the body of the sock is provided. The openings are sized sufficiently to allow a second sock to be threaded through the openings and retained to the sock thereby. Alternatively, a sock comprising a body and a channel formed in the body is provided. The channel is configured to receive and retain a portion of a second sock.

18 Claims, 1 Drawing Sheet

U.S. PATENT DOCUMENTS 5,970,524 A 10/1999 Becker et al.
5,974,590 A 11/1999 Stubbs
6,032,294 A 3/2000 Dean
6,038,748 A * 3/2000 Durney et al. ..... 24/302
6,092,241 A 7/2000 Bellet
6,135,974 A * 10/2000 Matz ..... 602/62
6,161,263 A * 12/2000 Anderson ..... 24/545
6,185,751 B1 2/2001 Mason
6,199,216 B1 * 3/2001 Weatherspoon ..... 2/239
6,237,158 B1 5/2001 Barbara
6,247,183 B1 * 6/2001 Haas-Laursen ..... 2/239
6,279,169 B1 8/2001 Reichle
6,324,698 B1 * 12/2001 Freeman ..... 2/239
6,374,420 B2 4/2002 Jossi
6,543,063 B2 * 4/2003 Greer ..... 2/239

* cited by examiner

DEVICE AND METHOD FOR JOINING A PAIR OF SOCKS

BACKGROUND OF THE INVENTION

It is a well-known phenomenon that socks get lost from their mates. Whether in the washing machine, in the sock drawer, or while transporting laundry to and from the laundromat, socks seem to disappear. Moreover, because it is common to own a number of socks of similar, but not necessarily identical, color and/or pattern, it is often necessary to spend a significant amount of time and energy matching socks after they are laundered. It is clear that a method and device for keeping a pair of socks together would be advantageous. A number of solutions have been proposed.

For example, International Application No. WO 91/04684 describes a sock fastening system for fastening together a pair of socks. The system described in the '684 application includes an elastic strip that is attached to the body of one of the socks. The elastic strip forms an expandable loop through which the other sock may be threaded. The strip is formed separately from the sock itself and is simply attached to the sock during manufacture by stitching each end of the strip to the sock.

U.S. Pat. No. 6,374,420 describes a fastener for fastening pairs of clothing items, such as socks, together. The fastener described in the '420 patent includes a first fastening element having at least one fastening projection in a center region, and a second fastening element having at least one opening for receiving the fastening projection. The projection of the first fastening element projects through a cut-out in a first textile label sewn to the first sock. The opening of the second fastening element also projects through a cut-out in a textile label sewn to the second sock.

U.S. Pat. No. 6,279,169 describes a device for sorting and storing socks. The device described in the '169 patent includes male and female clamping elements that can be fit together. The clamping elements include marks or other indicia to indicate ownership, color and original match.

U.S. Pat. No. 6,237,158 describes a clip assembly for matching socks to prevent the socks from being separated. The clip assembly described in the '158 patent includes a pair of dovetailed tongue and groove panels that can be joined by sliding the tongues on a first panel into the grooves on the other panel. The panels are attached to the exterior surface of each sock by a pin that penetrates the sock fabric.

U.S. Pat. No. 6,185,751 describes releasably engagable socks having a connecting device. The connecting device described in the '751 patent includes a pair of socks, with each sock having a pair of snap-type or Velcro® hook and loop fasteners attached to the sock. The fasteners may be used to join the two socks to each other, or folded upon themselves. The sock may include a patch that covers the fasteners on the inside, to make the sock more comfortable for the wearer.

U.S. Pat. No. 6,092,241 describes a fastener for keeping a pair of socks together. The fastener described in the '241 patent includes a snap fastener which may be received by a recess in a receptor plate. The snap fastener and receptor plate are each formed from a pair of plates that are attached to each other, through the sock, by a snap press fit. A flexible strap may attach the front and back of each of the plates.

U.S. Pat. No. 6,032,294 describes a fastener for mating pairs of clothing items. Each fastener is a snap fastener having a male part, a female part, and two securing parts. Each securing part has a set of prongs, which extend through the material of a tab and the sock. The prongs deform to attach the securing part to the rim of the corresponding male or female part.

U.S. Pat. No. 5,974,590 describes a pair of socks including a connector adapted to attach the socks together. The connector described in the '590 patent includes first and second members that can be attached to each other on opposite sides of a region of sock fabric. The connectors may include regions that can be marked with indicia.

U.S. Pat. No. 5,970,524 describes a pair of socks that may be joined together in a detachable fashion. The fastener described in the '524 patent may be a transparent snap having elements, which are woven, sewn, or pasted onto the leg portions of the respective socks. In the alternative, the snaps (which may also be hooks, or hook and loop Velcro® fasteners) may be attached to straps that are knitted into the leg portion of the sock.

U.S. Pat. No. 5,918,318 describes an attachment device for clothing items. The attachment device includes a pair of tabs formed from a strip of cloth or other material. Each tab includes a section of hook fastening elements and a section of loop fastening elements. The tabs can be folded over on themselves while the sock is being worn, and fastened to each other at other times.

U.S. Pat. No. 5,740,558 describes a device for attaching clothing articles together. The device described in the '558 patent includes a flexible strip stitched to the edge of each of a pair of socks. Each flexible strip includes a releasable fastening means such as a snap type fastener, which allows the two strips, and therefore socks, to be joined together.

U.S. Pat. No. 5,579,541 describes a fastener for keeping socks together. The fastener described in the '541 patent includes a sock having a tab attached along the edge of the sock. The tab and sock have, on adjacent surfaces, a complementary arrangement of hook and pile patches that can mate with each other so that the tab can be folded down on itself when the sock is being worn and the tabs can be mated to each other at other times.

U.S. Pat. No. 5,038,413 describes a sock-fastening device. The fastening device described in the '413 patent includes a pair of socks including a first sock and a second sock secured together by a snap-type fastening means. The snap-type fastening means includes a first fastener having a generally circular part providing a projection and a second fastener having a generally circular part providing a hole. When not joined to each other, each fastener may be adapted to receive a cover that provides a decorative appearance when the socks are being worn, and may be used to indicate that the two socks are a pair.

U.S. Pat. No. 4,058,853 describes a securing method for keeping socks together. The '853 patent describes a pair of socks having a pair of fastener patches. The fastener patches are formed of a flexible material such as Velcro® hook and pile (or hook and loop) fasteners. The patches may be sewn on to the socks, coated with a thermoplastic and ironed on, or glued on with epoxy cement. The hook patch may have a cover to prevent the path from sticking to the wearer's pants or trousers.

U.S. Pat. No. 2,785,413 describes a method for holding socks in pairs for laundering. Each sock includes a band, which encircles the cuff and is loosely secured thereto by a series of spaced loops, which extend over the band and are secured to the cuff of the sock. The loops may be embroidered on the socks after knitting, or formed during the knitting of the socks. A retaining strip including a plurality of loops and is adapted to encircle the bands of a pair of socks and keep the socks together. The band additionally acts as a garter and a guide for folding the cuff.

U.S. Pat. No. 2,663,877 describes a fastener for keeping socks together. As shown above, the fastener includes a small piece of tape, which is stitched or otherwise secured to a sock. A snap fastener or other connecter is affixed to the tape. In the alternative, the connector (usually a male to female type of connector) may be secured directly to the sock.

In each of these prior art methods and devices, the fasteners are formed from distinguishable material that gives the socks an unsightly and non-uniform appearance. Furthermore, those prior art devices and methods that rely on a patch, cap, or cover, to create a smooth appearance when the socks are being worn, require that the user not lose the patch, cap or cover while the socks are joined together. Moreover, during vigorous washing, as might be encountered in a washing machine, the socks which are attached at a single point with a button, snap, hook and loop fastener, or the like may become so entangled with other clothing items that the forces encountered during washing separate the socks from each other. Finally, a number of the above-described prior art methods and devices rely on hook and loop fasteners, hooks, pins, etc., which may snag, pull, or otherwise harm knits or other fabrics.

The advantages of the present invention will be understood more readily after a consideration of the drawings and the Detailed Description.

SUMMARY OF THE INVENTION

In a first embodiment, the present invention provides a sock comprising first and second openings positioned along the body of the sock. The openings are sized sufficiently to allow a second sock to be threaded through the openings and retained to the sock thereby. In another embodiment, the present invention provides a sock comprising a body and a channel formed in the body. The channel is configured to receive and retain a portion of a second sock.

DETAILED DESCRIPTION AND BEST MODE OF THE INVENTION

Figure 2:
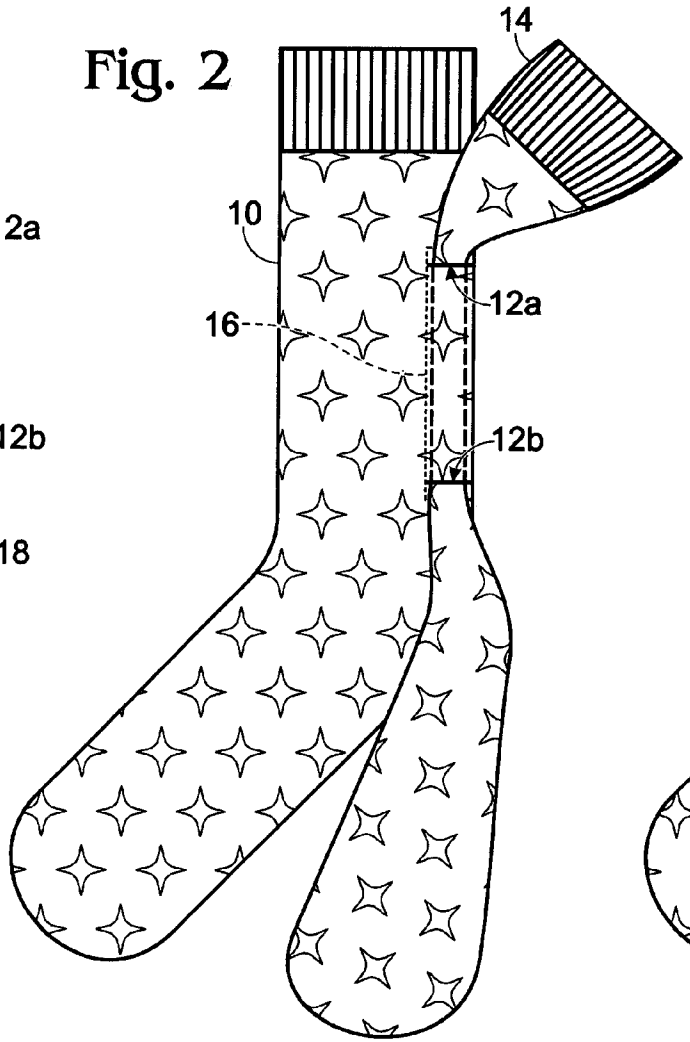
FIG. 2 depicts the sock of FIG. 1 securely mated with a second sock.
Figure 1:
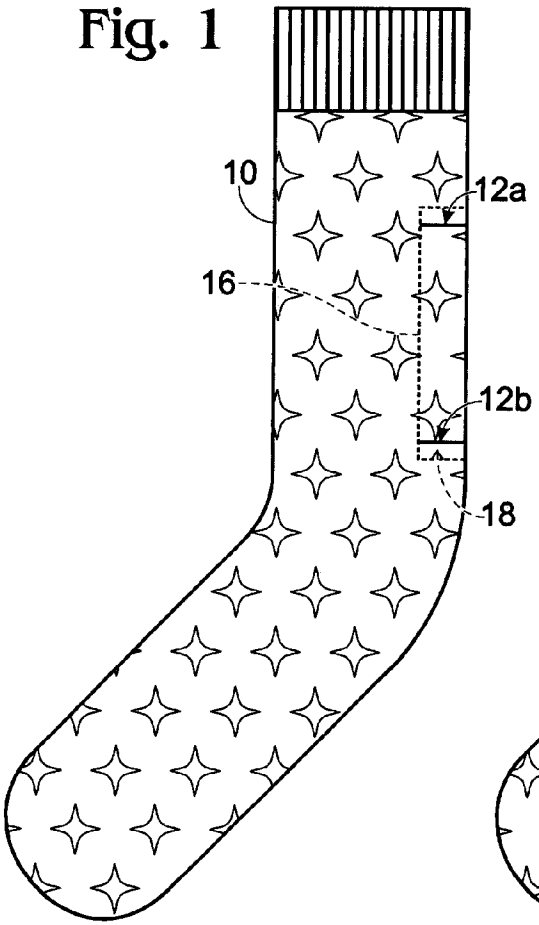
FIG. 1 depicts a sock employing a first embodiment of the present invention.

The present invention provides a method and device for securely mating a pair of socks. Viewing FIGS. 1 and 2 together, sock 10 includes a pair of slits, or openings, 12*a* and 12*b*, through which a second sock 14 may be threaded. As illustrated in dashed lines in FIGS. 1 and 2, and as discussed in more detail herein, the sock includes a swatch of material 16 that is attached to an internal surface of the sock and sized to extend behind a localized region of the internal surface of the sock proximate to the slits, with the swatch thereby preventing a wearer's leg from being visible through the slits when the sock is worn.

Slits 12*a* and 12*b* may be of any suitable size, as is necessitated or desired according to function and aesthetic sensibilities. For example, a heavier weight wool sock may require larger slits than a lighter weight nylon sock. Moreover, slits that are too large may fail to properly retain the second sock or may disrupt the uniform appearance of the sock when it is being worn. However, in the embodiments where a fabric swatch is employed, as described in greater detail below, the slits or openings may be increased in size (height, width, or a combination of both) to accommodate ease of use.

Moreover, the distance between slits 12*a* and 12*b* may likewise be a product of function or aesthetic sensibility. For example, it may be easier to thread a lighter weight sock through slits that are closer together and a heavier weight sock through slits that are further apart. As non-limiting examples, slits that are 0.5 or less inches apart, 1 inch apart, 2 inches apart, 3 inches apart, 4 inches apart or even 5 or more inches apart are contemplated by the present invention.

It will be appreciated that the slits may be located in any position on the sock. As an example, it may be desirable to locate the slits along the leg portion of the sock, as this area is less likely to present irritation to the wearer and the slits may be covered by the bottom of the wearer's pantleg.

Slits 12*a* and 12*b* are typically finished so as not to unravel. For example, they may be serged, seemed, bound, sealed (as in with an adhesive), etc., as is appropriate for the specific material used.

As shown, because the slits are formed in the fabric of the sock, the line of the sock and pattern on the fabric is not interrupted. If desired, a fabric swatch 16 may be sewn or otherwise formed (i.e. knit) behind slits 12*a* and 12*b*. Fabric swatch 16 may be attached to sock 10 along the entire perimeter of the swatch such that the fabric swatch together with the slits forms a channel 18, through which second sock 14 may be inserted. Alternatively, fabric swatch 16 may be attached to sock 10 only along one or more portions of the perimeter of the swatch to facilitate the threading or insertion of second sock 14 into slits 12*a* and 12*b*. For example, the fabric swatch may be identical in color and pattern to the external appearance of sock 10 such that any space or gap that might be caused by slits 12*a* and 12*b* when the sock is worn is obfuscated.

Figure 3:
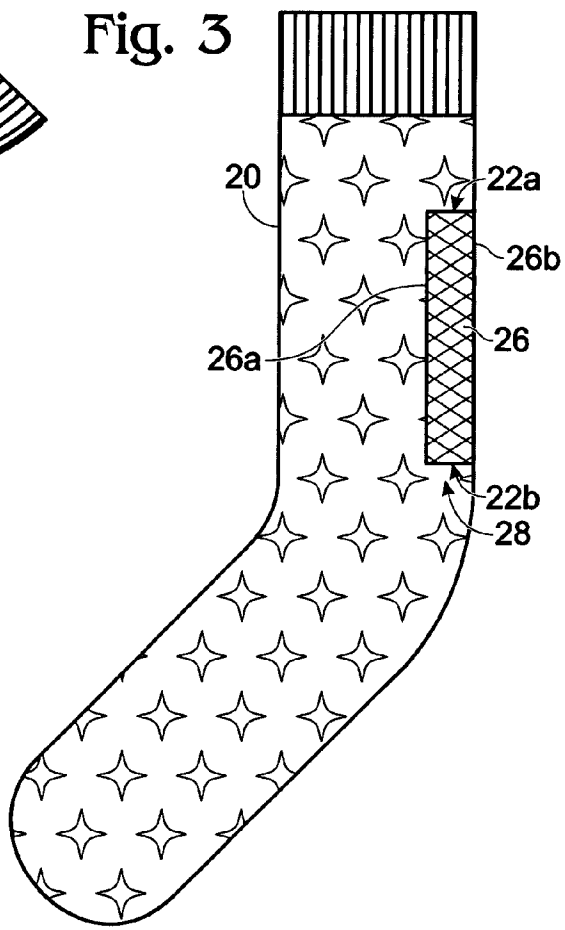
FIG. 3 depicts a sock employing a second embodiment of the present invention.

An alternative embodiment is shown in FIG. 3. In this embodiment, sock 20 includes a fabric swatch 26 attached to the outside of the sock. Swatch 26 is typically attached along two parallel edges, i.e. along both sides or along the top and bottom, thus forming a channel through which a second sock may be threaded. For example, in the depicted embodiment, swatch 26 is attached to sock 20 along sides 26*a* and 26*b*, leaving openings 22*a* and 22*b*, thus forming a channel 28, through which a second sock (not shown) may be threaded.

Swatch 26 may be formed of a material that is identical to the material used to form sock 20. Alternatively, swatch 26 may be formed of a material that is different from the material used to form a sock. Moreover, if desired, swatch 26 may be attached to sock 20 in such a manner that the seam lines and openings are invisible or substantially invisible to someone viewing the sock while it is being worn.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and sub-combinations of features, functions, elements, and/or properties may be claimed in a related application. Such claims, whether they are directed to a different invention or directed to the same invention, whether different, broader, narrower or equal in scope to any original claims, are also regarded as included within the subject matter of the inventions of the present disclosure.

I claim:

1. A sock comprising a body, the body comprising an external surface and an internal surface, wherein at least a substantial portion of the internal surface is adapted to contact a wearer when the sock is worn by a user, the sock further comprising first and second slits extending through the body of the sock from the external surface to the internal surface, the openings being sized sufficiently to allow a second sock to be threaded through the slits and retained to the sock thereby, wherein the sock further comprises a swatch of material behind the slits and sized to extend behind a localized region of the internal surface of the body proximate the slits such that a wearer's leg is not visible through the slits while the sock is being worn, and further wherein the swatch of material is attached to the internal surface of the sock and configured to contact the second sock when the second sock is threaded through the slits.

2. The sock of claim 1 where the slits are spaced apart parallel slits.

3. The sock of claim 2, wherein the body includes a leg portion, and further wherein the slits extend through the leg portion of the body of the sock.

4. The sock of claim 1 wherein the body of the sock is formed from a material, and further wherein the swatch of material behind the slits is formed from the same material.

5. The sock of claim 1 where the slits are spaced apart a distance of five inches or less.

6. The sock of claim 1, wherein the body includes a leg portion, and further wherein the slits extend through the leg portion of the body of the sock.

7. The sock of claim 1, wherein the slits are finished slits that are adapted not to unravel.

8. The sock of claim 7, wherein each slit includes a perimeter that is at least one of serged, seamed, bound, and sealed.

9. The sock of claim 7, wherein the body includes a leg portion, and further wherein the slits extend through the leg portion of the body of the sock.

10. The sock of claim 1, wherein the body is formed from fabric and the slits are formed in the fabric.

11. The sock of claim 1, wherein the swatch of material is a fabric swatch.

12. The sock of claim 1, wherein the swatch of material is sewn to the body.

13. The sock of claim 1, wherein the swatch of material is knit to the body.

14. The sock of claim 1, wherein the swatch of material includes a perimeter, and further wherein the swatch of material is attached to the body of the sock along a portion of the perimeter of the swatch of material.

15. The sock of claim 1, wherein the swatch of material defines, with the body of the sock, a channel through which the second sock may be inserted.

16. The sock of claim 1, wherein the swatch of material includes a perimeter, and further wherein the swatch of material is attached to the body of the sock along the entire perimeter of the swatch of material.

17. The sock of claim 15, wherein the slits are spaced apart by a distance of five inches or less.

18. The sock of claim 15, wherein the slits include finished slits that are adapted not to unravel.

* * * * *